US005392800A

United States Patent [19]

Sergi

[11] Patent Number: 5,392,800

[45] Date of Patent: Feb. 28, 1995

[54] MULTI-PURPOSE CANE DEVICE

[76] Inventor: Michael V. Sergi, P.O. Box 1313, Erie, Pa. 16512

[21] Appl. No.: 942,583

[22] Filed: Sep. 9, 1992

[51] Int. Cl.[6] ..... A45B 3/00

[52] U.S. Cl. ..... 135/65; 135/84; 135/77; 223/118

[58] Field of Search ..... 135/65, 66, 77, 80, 135/84; 223/118, 119

[56] References Cited

U.S. PATENT DOCUMENTS

| | | | |
|---|---|---|---|
| 2,346,038 | 4/1944 | Mason | 135/66 |
| 3,591,226 | 7/1971 | Elmore, Jr. | 294/19 |
| 4,434,808 | 3/1984 | Burak | 135/80 |
| 4,709,839 | 12/1987 | Tucker | 223/119 |
| 4,811,750 | 3/1989 | McAllister | 135/66 |
| 4,827,956 | 5/1989 | Toot | 135/66 |
| 4,947,882 | 8/1990 | Levasseur | 135/84 |
| 4,966,316 | 10/1990 | George et al. | 223/119 |
| 5,101,845 | 4/1992 | Kravetz | 135/66 |

FOREIGN PATENT DOCUMENTS

| | | | |
|---|---|---|---|
| 0906062 | 12/1945 | France . | |
| 2342679 | of 1977 | France | 135/66 |
| 2536639 | 6/1984 | France | 135/77 |
| 2614529 | 11/1988 | France | 135/65 |
| 0675275 | 7/1952 | United Kingdom | 135/84 |
| 0998788 | 7/1965 | United Kingdom | 135/77 |
| 2122077 | 1/1984 | United Kingdom | 135/84 |

*Primary Examiner*—Carl D. Friedman
*Assistant Examiner*—Winnie Yip
*Attorney, Agent, or Firm*—Hodgson, Russ, Andrews, Wood & Goodyear

[57] ABSTRACT

A cane device (10) that provides a remote object gripping mechanism (14), a shoe horn (16), and a rod (18) providing a righting means for the device, is described. The remote object gripping mechanism is comprised of a trigger (36), a gripping claw (38) and a connecting linkage of a cable (40). The trigger is mounted on the cane (12) adjacent the handle (22) and is actuated to move in turn the cable, which is mounted inside the cane, to in turn move the claw towards a support foot (24) for gripping and manipulating remote objects without the user needing to stoop. The righting means extends from the shaft ( 20 ) adjacent the support foot. When the cane is dropped on the floor (71), the user is able to step on the righting means to cause the cane handle to swing upwardly so that the user can reach the handle without having to bend over. The shoe horn is an elongated member that enables the user to put on a shoe without having to stoop.

14 Claims, 2 Drawing Sheets

MULTI-PURPOSE CANE DEVICE

BACKGROUND OF THE INVENTION

The present invention relates to a cane device. In particular, the present invention relates to a multi-purpose cane device that I refer to as a "Cane-Aid". The cane device helps a user walk and support himself in an erect position and enables a person to pick up an object off the floor or from a remote location without having to stoop. The cane device is also provided with a shoe horn that helps the user put on a shoe without bending forward. Further, the cane device has a righting mechanism that enables the person to reach the handle after the cane has been dropped on the floor without having to bend over.

Many people are afflicted with cronic back, hip or other movement restricting conditions that are both painful and very limiting. These people often find simple tasks such as bending over to pick up an object off the floor or to slip on a shoe nearly impossible because of their limited mobility. When they are able to bend over to perform such tasks, the movement is often accompanied by a great deal of pain. In addition, certain types of surgery require that the patient not lean or bend over during the healing period. The end result is that such people are often unable to lead "normal" lives and must be dependent upon a helper to perform nearly every task that requires even the slightest amount of bending or stooping movement.

In that respect, the cane device of the present invention performs a variety of functions that help people perform daily light work around a household without having to stoop or bend their backs from an erect position, whether standing or seated. Not only does this help these people lead relatively comfortable and therefore more fulfilling lives, but the lack of stooping or bending movement can speed the healing process.

The cane device is comprised of an elongated shaft having a handle at one end and a support foot at an opposite, distal end. Between the ends, the shaft is a hollow tubular member that provides for mounting a linkage. The linkage extends between a trigger, mounted adjacent the handle, and a holding mechanism that is pivotably mounted to the shaft adjacent the support foot. The holding mechanism is a generally L-shaped member having a short side pivotably mounted on the shaft with a gripper portion at a remote end of a long side. The gripper portion is movable towards and away from the support foot. A pulley wheel is mounted within the shaft at an intermediate position between the pivotable connection of the holding mechanism and the support foot. A cable, comprising the linkage, extends from the trigger through the hollow shaft, over the pulley wheel and connects to the holding mechanism adjacent the apex between the long and short sides. When the trigger is actuated, the cable moves towards the handle with the distal portion of the cable rolling over the pulley in a direction to pull the holding mechanism towards the support foot for holding an object to be gripped therebetween. A spring normally biases the holding mechanism to an extended position with the gripper portion spaced from the support foot. A locking mechanism is provided that enables the holding mechanism to be secured in a retracted position for using the device as a cane.

The support foot is preferably provided with a magnet for engaging magnetic objects with the cane device.

In addition, a small diameter rod is provided at the distal end, extending perpendicularly from the shaft. Should the cane device be dropped, the user can step on the rod, which serves as a righting mechanism, causing the cane to swing upwardly. The user is then able to grasp the handle without having to stoop.

Furthermore, an elongated shoe horn is mounted on the shaft. The shoe horn can be removed from the shaft and in conjunction with the holding mechanism, used to manipulate a shoe so that the user can slip the shoe on his foot without having to stoop. The shoe horn is then replaced on the cane device. Personal effects such as a flashlight, a compartment for carrying pills and the like, an alarm and other similar devices can also be mounted on the cane device so that they are readily available when the person needs them.

PRIOR ART

The prior art has described various devices provided with remote grasping mechanisms. Illustrative of these devices are U.S. Pat. Nos. 3,591,226 to Elmore, Jr. et al; 4,709,839 to Tucker; 4,811,750 to McAllister; 4,827,956 to Toot; and 4,966,316 to George et al.

Elmore, Jr. et al describes a gripping device that includes an elongate tube formed with a handle at one end and a shoe horn at the other end. An arm is pivotably mounted on the tube and is connected to a cable that extends through the tube to the handle. That way, the arm is useful for gripping an object in cooperation with the shoe horn by remote actuation of the handle. This device does not serve as a cane and is not provided with a righting mechanism for righting the device after it has been dropped.

Tucker describes a shoe butler comprised of an elongated shaft provided with a pivotable handle connected to a flexible band. The band extends through the shaft and serves to effect a pinching action between a rigid shoe horn and an associated spring-biased clip member secured to a remote end of the shaft. This device is not a cane, is not particularly adapted for manipulating remote objects, other than shoes and is not provided with a righting mechanism.

McAllister describes a cane having a finger assembly mounted on the lower portion of the cane. A locking mechanism enables the finger assembly to be locked in an infinite number of positions between a fully extended position and a fully retracted position for gripping and holding objects of various sizes. This device is mechanically more complicated than the present invention and is not particularly adapted for putting on shoes. There is also no righting structure on this cane.

Toot describes a remote grasping device mounted on a cane that includes a pair of opposed jaw-like gripping members mounted on the lower end of the cane. The gripping members are operated by a motor controlled by a switch mounted on the cane handle. This device is not particularly useful for putting on shoes and does not have a righting mechanism.

George et al describes a combination shoe horn and cane apparatus having a pivotable clamping member that cooperates with the shoe horn for gripping and holding objects therebetween. The clamping member is actuated by a mechanical linkage that is mounted outside and along the cane member. The shoe horn is removable for attaching a cane support foot to the device. The clamping member does not abut against a remote end of the shoe horn or the support foot. Therefore, the cane apparatus is not particularly useful for picking up smaller objects. Also this cane apparatus is not provided with a righting structure.

What is needed is a cane device that helps a user stand in an erect position and that enables the user to reach and hold an object off the floor or from a remote location without having to stoop out of an erect position. The cane device also needs to help a user put on shoes while standing erect. In addition, the cane device needs to have a righting structure that enables the user to grasp the handle of the device without stooping. That way, should the user inadvertantly drop the cane device, all the user needs to do is step on the righting mechanism. This causes the cane device to rotate upwardly to a position where the user can reach the handle without having to stoop.

OBJECTS OF THE PRESENT INVENTION

It is therefore an object of the present invention to provide a cane device that helps support a user in an erect walking position and that provides a remote object gripping mechanism that enables the user to hold and manipulate a retrievable object without having to stoop.

Still further, it is an object of the present invention to provide a cane device having a remote object gripping mechanism that in conjunction with an associated shoe horn enables the user to put on a shoe without bending over.

Furthermore, the present invention provides a foot-actuated, righting structure that enables the user to retrieve the handle of the cane device without having to stoop.

Finally, it is an object of the present invention to provide a cane device that is easy to use, is inexpensive to build and that enables a user to perform light work such as retrieving objects from the floor and putting on a shoe without having to stoop.

These and other objects will become increasingly apparent by reference to the following description and the the drawings.

IN THE DRAWINGS

FIG. 1 is a side elevational view of a preferred embodiment of the cane device 10 of the present invention showing the claw 38 in the retracted position.

FIG. 1*a* is a side elevational view of a shoe horn 16 that is mountable on the shaft 20 of the cane device 10.

FIG. 1*b* is a side elevational view of an alarm 86 that is mountable on the shaft 20 of the cane device 10.

FIG. 1*c* is a side elevation view of a pill case 88 that is mountable on the shaft 20 of the cane device 10.

FIG. 1*d* is a side view of a flash light 90 that is mountable on the shaft 20 of the cane device 10.

Figures 1, 1A, 1B, 1C, 1D, 2, 3, 4, 5:
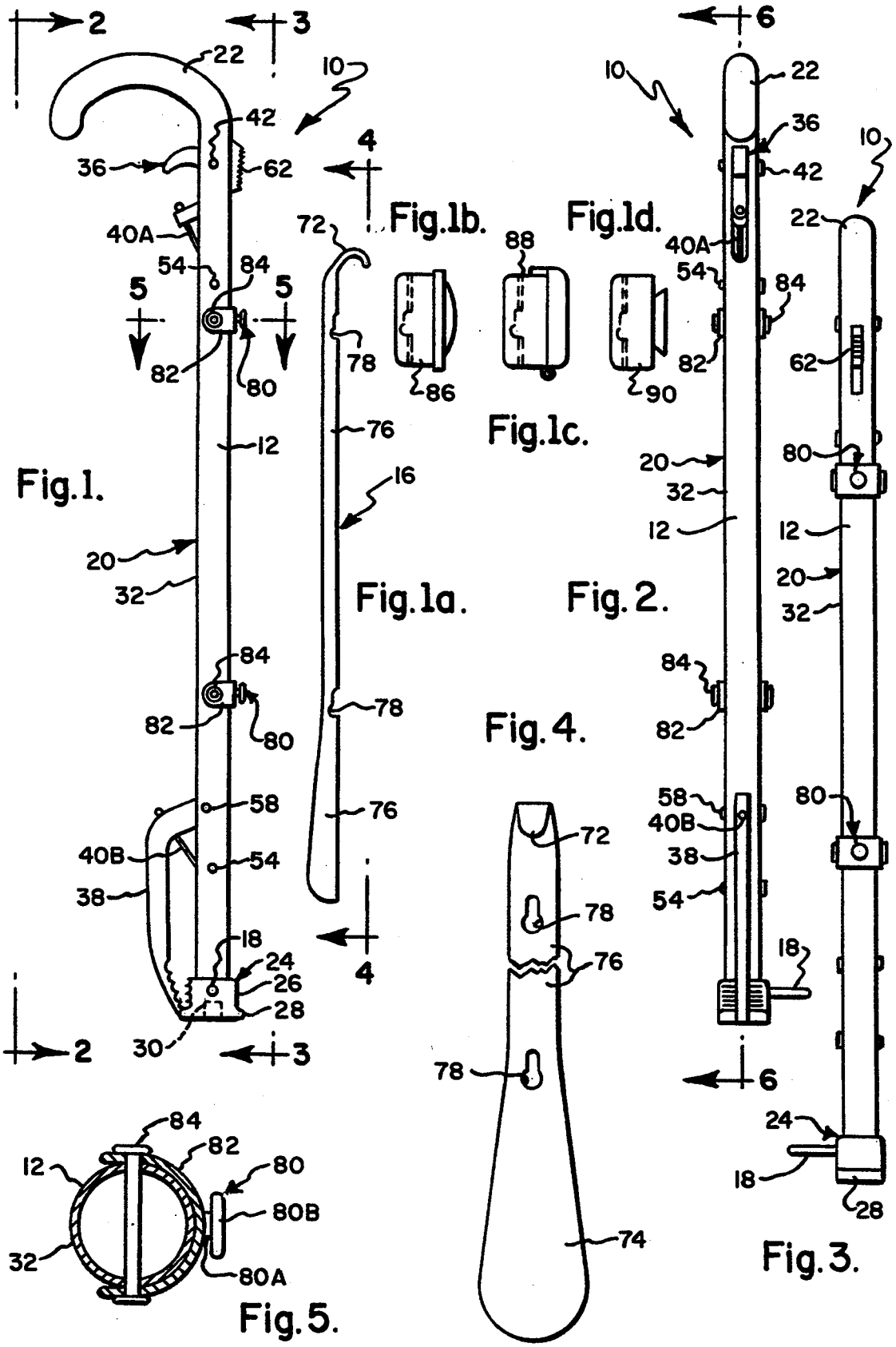
FIG. 2 is a view along line 2—2 of FIG. 1.
FIG. 3 is a view along line 3—3 of FIG. 1.
FIG. 4 is a view along line 4—4 of FIG. 1*a* partially broken away for ease of illustration.
FIG. 5 is a cross-sectional view along line 5—5 of FIG. 1.
Figure 8:
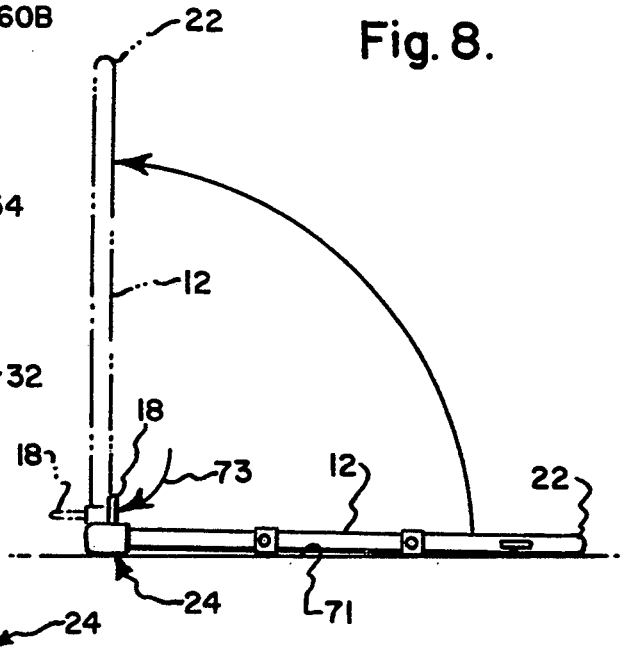

FIG. 8 is a front view of the cane device 10 show in FIG. 1 and showing the extending rod 18 serving as a righting means for moving the device 10 into an upright position (dashed lines).

SPECIFIC DESCRIPTION

FIGS. 1 to 8 show a preferred embodiment of the cane device 10 of the present invention. The cane device 10 is comprised of a cane member 12 that serves to mount a remote object gripping mechanism, generally indicated at 14 (FIG. 6), a shoe horn 16, and an extending rod 18 that helps a user manipulate remote objects and that also provides a righting means for the cane device 10, as will be described in detail hereinafter. The cane member 12 can be made from metal, plastics, wood, composite material or other suitable materials. The cane member 12 has an elongated, hollow shaft 20 having a curved handle 22 at the proximal end with a remote support foot 24 mounted at the opposite, lower end. As particularly shown in FIGS. 1, 2 and 6, the support foot 24 is comprised of a cylindrically shaped collar 26 and a foot portion 28. The support foot 24 is preferably made from an elastomeric material. The support foot 24 can also be made from a plastic or other suitable material and is securely fitted on the lower end of the shaft 20. That way the support foot 24 can be removed from the cane 12 and replaced when the foot 24 wears out. The foot portion 28 is preferably provided with gripping treads (not shown) on the bottom that helps keep the cane device 10 from sliding on slippery surfaces. In addition, the support 24 has a magnet 30 mounted in a recess in the foot portion 28. The magnet 30 enables magnetic objects to be engaged by the cane device 10.

Figure 6:
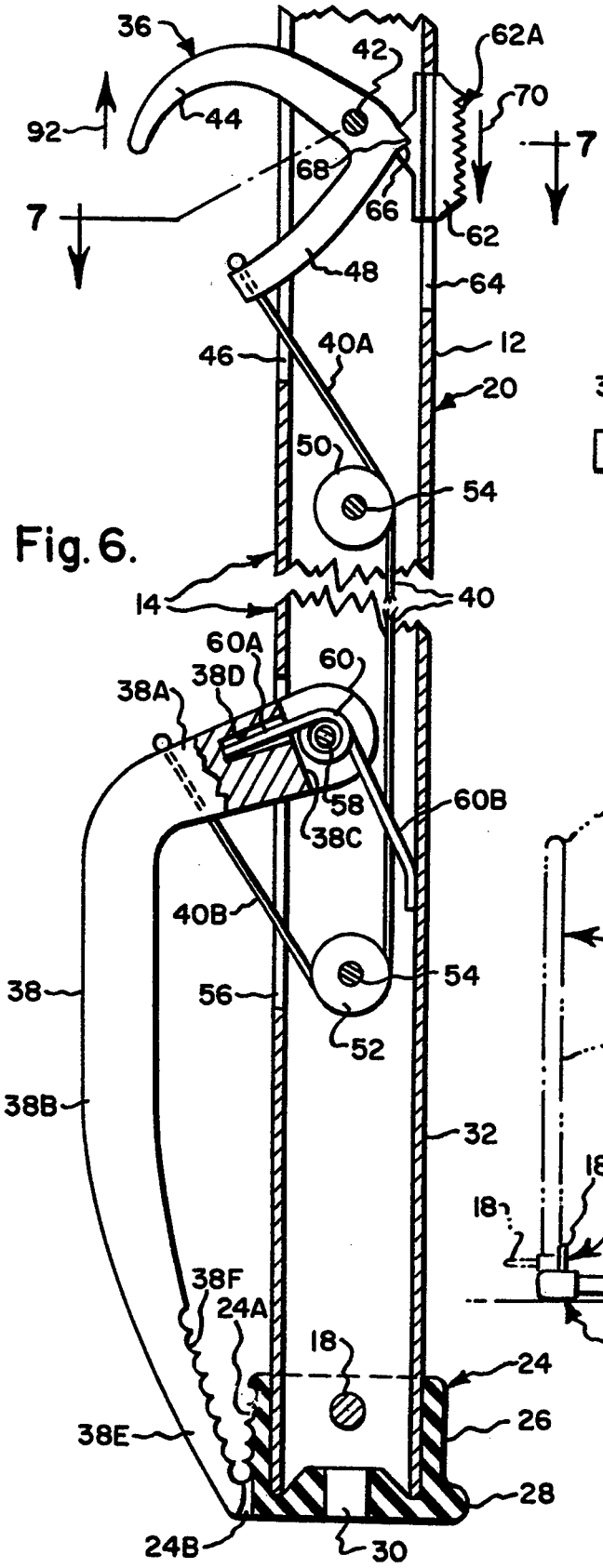
FIG. 6 is a enlarged longitudinal-sectional, partially broken away view for ease of illustration, along line 6—6 of FIG. 2.

As particularly shown in FIG. 6, the hollow shaft 20 is a tubular member having a circular cross-section along and around the longitudinal axis of the shaft 20 and is comprised of a sidewall 32 having an inner surface. The shaft 20 supports the remote object gripping mechanism 14, which is comprised of a trigger 36, a gripping claw 38 and a connecting linkage provided by cable 40. The trigger 36 is generally C-shaped and is pivotally mounted on the shaft 20 adjacent the handle 22 by a shoulder rivet 42 or similar fastening means. The trigger 36 includes a hooked finger portion 44 that extends through an opening 46 in the sidewall 32 and an anchor portion 48. The finger portion 44 is adjacent the handle 22 of cane 12 so that a user can hold the cane 12 by the handle 22 and actuate the finger portion 44 with one of his fingers. The proximal end 40A of the cable 40 is moored to the anchor portion 48 and the cable 40 extends through the hollow shaft 20 and over the first pulley wheel 50 mounted adjacent trigger 36, over a second pulley wheel 52 mounted adjacent the support foot 24 to a remote end 40B moored to gripping claw 38. The first and second pulley wheels 50 and 52 are comprised of grooved rims (not shown) that help to hold the cable 40 and are mounted to the shaft 20 along the longitudinal axis by rivets 54 or similar mounting means. The wheels 50 and 52 can rotate on their rivets 54 to provide for a smooth cable 40 movement, although this is not necessary. Instead, the cable 40 can ride over the pulleys 50 and 52 as stationary devices.

Gripping claw 38 serves as a holding means and has a generally L-shape with a short side 38A that extends through an opening 56 in the outside sidewall 32 and forms an apex with a long side 38B. The short side 38A of claw 38 is pivotably mounted to shaft 20 by a rivet 58 and provides for mounting the remote end 40B of cable 40 adjacent the apex of the claw 38. The short side 38A is comprised of spaced apart sidewalls 38C (only one shown in FIG. 6) that form into a recess 38D. A coil spring 60 is mounted between the sidewalls 38C on rivet 58 with a tang portion 60A mounted in recess 38D and a leg 60B tensioned against the inner surface 36 of shaft 20. That way, spring 60 serves to bias the claw 38 in to extended position (not shown) with a gripper portion 38E of the long side 38B spaced from the support foot 24. The gripper portion 38E has serrations or teeth 38F that cooperate with teeth 24A on support foot 24 to hold an object (not shown) to be manipulated therebetween, as will be explained in detail hereinafter. As shown in FIG. 3, support foot 24 is also provided with a recess 24B (FIG. 6) that receives the remote end of the gripper portion 38E when the claw 38 is retracted.

Figure 7:
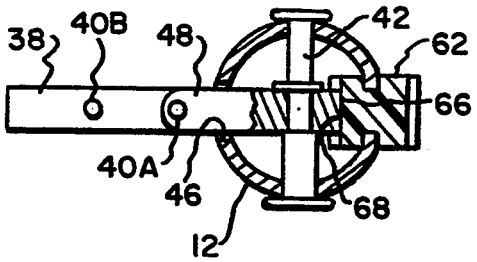
FIG. 7 is a cross-sectional view along line 7—7 of FIG. 6.

As shown in FIGS. 6 and 7, the claw 38 is locked in the retracted position by thumb lever 62. Thumb lever 62 slides in a track 64 provided in the sidewall 32 of shaft 20, opposite opening 46 for trigger 36, and has an inwardly extending notch 66 that receives a protrusion 68 on trigger 36 to hold the trigger 36 in the closed position with the remote end of the gripper portion 38E of claw 38 received in the recess 24B of support foot 24. Sliding the lever 62 in a downward direction, as shown by arrow 70, toward the support foot 24 disengages the notch 66 from the protrusion 68, which releases the trigger 36 and enables spring 60 to bias the claw 38 to an extended position (not shown). Lever 62 has a knurled surface 62A that aids the user in gripping the lever 62 with his thumb.

As particularly shown in FIGS. 3 and 6, rod 18 is mounted on the lower end of the shaft 20 and extends perpendicularly through an opening in support foot 24. Rod 18 serves as a means for catching, holding and manipulating remote objects, such as pulling open a drawer. Rod 18 thus functions as an object manipulating means for the cane device 10.

As shown in FIG. 8, should the cane 12 drop to the floor 71, the plane of the cane 12 extending through the longitudinal axis and including the shaft 20, the handle 22 and the claw 38 will lay parallel to the floor 71. Rod 18 extends at a position normal to this plane. The user can then place his foot on the rod 18, applying a force on the rod 18, as shown by arrow 73. This causes the handle 22 to swing upwardly (shown in dashed lines in FIG. 18). The user then can reach the handle 22 without stooping. It should be understood that rod 18 need not necessarily be perpendicular to the axis of the shaft 20. It is contemplated that the rod 18 can be mounted at any angle with respect to the longitudinal axis that will provide a righting action when stepped on.

As shown in FIGS. 1*a* and 4, the shoe horn 16 is an elongated member having a handle 72 and a curved horn portion 74 at opposed ends of a rigid shank 76. The horn portion 74 is of a conventional type and is useful for helping a user put on a shoe (not shown), as is known. The shank 76 has an arcuate cross-section along its length that provides for mounting the shoe horn 16 on the circular outside sidewall 32 of shaft 20. To that end, the shank 76 is provided with at least two key-shaped openings 78 along its length. As particuarly shown in FIG. 5, each tab 80 is mounted on an arcuately shaped saddle 82 that is mounted on the shaft 20 by a rivet 84. Tab 80 is comprised of a rod 80A supporting an enlarged head 80B. To mount the shoe horn 16, the enlarged heads 80B are moved through the corresponding enlarged portion of key-openings 78 until the shank 76 is resting against the saddles 82. The shoe horn 16 is then moved axially along the shaft 20 towards the support foot 24 to align the tabs 80 with the reduced portion of key-openings 78 to lock the shoe horn 16 on the cane 12. It should be understood that depending on the material of the cane 12, the tabs 80 can be formed as integral parts of the shaft 20. This would eliminate the saddle 82 and rivet 84.

As shown in FIGS. 1*b*, 1*c* and 1*d*, instead of or in addition to the shoe horn 16, the cane 12 is able to support a number of containers providing an alarm 86, a pill case 88 and a flash light 90, respectively. These devices are mounted on the shaft 20 in the same manner using the locking tab 80 and key-openings 78 as that provided for shoe horn 16. It should be appreciated that the alarm 86, pill case 88 and flash light 90 are only representative of the types of devices that can be mounted on the shaft 20 of cane 12 and that the types of devices are only limited by the imagination of the user. It should also be understood that the shoe horn 16 and accessories 86, 88, and 90 can be mounted in the cane 12 by other attaching means, for example by Velcro ®.

In Use

The cane device 10 is useful for gripping and manipulating a remote object (not shown) without the user having to stoop out of the erect position. To grip an object, the user moves the thumb lever 62 in the direction shown by arrow 70 (FIG. 6) to release trigger 36. Biasing spring 60 then actuates the claw 38 to an extended position (not shown) with the gripper portion 38E spaced from the support foot 24. The claw 38 and support foot 24 can then be placed in a straddling relationship, on opposed sides of the object to be gripped. Trigger 36 is actuated by pulling the finger portion 44 in the direction shown by arrow 92, to actuate the claw 38 towards the support foot 24 to grip and hold the object. When the trigger 36 is actuated, the anchor portion 48 of trigger 36 moves in the direction of arrow 92, which pulls the proximal end 40A of cable 40 upwardly towards the handle 22. The cable 40 moves upwardly, over the pulley wheels 50 and 52 to cause the remote end 40B of cable 40 to move towards the support foot 24. This causes the claw 38 to retract towards the support foot 24 and against the bias force of spring 60 to grip and hold the object therebetween. Serrations 38F on claw 30 and teeth 24A on support foot 24 help hold the object.

To release the object, the finger portion 44 of trigger 36 is released from the user's hand. This permits spring 60 to bias the claw 38 outwardly into an extended position, spaced from the support foot 24. As the claw 38 moves outwardly, the remote end 40B of cable 40 moves toward handle 22, which causes cable 40 to ride over the pulley wheels 50 and 52 towards the support foot 24 to pull the finger portion 44 of claw 38 downwardly away from handle 22. The claw 38 is now released from the object and is in a position to re-grip the object or to grip a different object.

After the claw 38 has been released from the object, the trigger 36 is actuated to pull the claw 38 into the recess 24B of the support foot 24. The claw 38 can then be locked in this retracted position by the thumb lever 62 (FIG. 6), as has been previously described.

Should the cane device 10 inadvertantly be dropped on the floor 71, the cane device 10 will land in the position shown in FIG. 8 with the plane of the cane member 12 parallel to the floor 71. The extending rod 18 adjacent the foot support 24 is normal to the plane.

The user can step on the rod 18, which applies pressure on rod 18 as shown by arrow 73. This causes the cane 12 to swing upwardly to an erect position (shown in dashed lines). The user is then able to reach the handle 22 without having to stoop.

The cane device 10 also helps a user put on a shoe (not shown). The shoe horn 16 is removed from the shaft 20 by pulling on handle 72 in a upwardly direction. This aligns the enlarged portions of key-opening 78 with the enlarged heads 80B of tabs 80. The shoe horn 16 is then moved away from the shaft 20 with the heads 80B moving through the key-openings 78. The shoe horn 16 is now usable in a manner well known to those skilled in the art for putting a shoe on the user's foot.

In those situations where the user is putting on a tennis shoe or sneaker, the user can first tie the laces to fit his foot. The extending rod 18 is then moved through the cloth strap that is typically sewn on the outside of the shoe tongue to pull the tongue open. The shoe horn 16 is placed against the back of the shoe and while the tongue is held open by rod 18, the user slips his foot into the shoe. Since the material comprising the tennis shoe typically has some degree of stretch, the shoe will fit snugly on the foot once the shoe horn 16 and rod 18 are removed.

The alarm 86, pill case 88 or flash light 90 are removable from the shaft 20 in a similar manner as the shoe horn 16. They are then able to be used for their intended purposes.

It is intended that the foregoing description be only representative of the present invention and that the present invention be limited only by the hereinafter appended claims.

What is claimed is:

1. A cane device that helps a user stand in an erect posture and that enables the user to manipulate an object positioned on a lower support surface while the user stands erect, the cane device comprising:

(a) an elongated shaft means having a handle means at one end, an opposite support end and an intermediate section along a longitudinal axis of the shaft means between the ends, wherein the support end is provided with a friction means for contacting the support surface in a non-slip engagement and a magnet means for engaging magnetic objects and wherein the shaft means has a length that enables the user to hold the handle means and position the support end having the friction means on the support surface to help the user stand in the erect posture;

(b) a holding means pivotably mounted on the shaft means adjacent to the support end;

(c) a trigger means mounted on the shaft means adjacent to the handle means;

(d) an actuating means controllable having pulley means to provide changing cable direction means by the trigger means and connected to the holding means to provide for moving the holding means with respect to the support end to hold the object between opposed surfaces provided by the holding means and the support end for manipulating the object; and (e) a righting means supported from the intermediate section of the shaft means adjacent to the support end without interfering with the movement of the holding means so that when the cane device is released from the user's hand and comes to rest in a generally horizontal righting position on the support surface, the righting means is spaced above the support surface with a portion of the friction means opposite the righting means contacting the support surface in the non-slip engagement, wherein the user can place his foot on the righting means to thereby cause the handle means to swing upwardly and into a somewhat vertical position towards the user's hand by pivoting on the friction means which prevents the support end from slipping on the support surface so that the handle means is able to be reached by the user without the user having to stoop out of the erect posture.

2. The cane device of claim 1 wherein the holding means is an L-shaped member having a short side pivotably mounted on the shaft means and a long side movable away from and toward the support end in response to the actuating means controlled by the trigger means.

3. The cane device of claim 2 wherein a distal end of the long side of the holding means, remote from the shaft means is provided with gripping teeth that help hold the object between the holding means and the support end of the shaft means.

4. The cane device of claim 3 wherein the intermediate section of the shaft means is hollow along the length of the intermediate section with a linkage means comprising the actuating means positioned inside the intermediate section and actuatable by the trigger means for moving the holding means with respect to the support end of the shaft means.

5. The cane device of claim 4 wherein a change of direction means is mounted on the shaft means adjacent to the handle means at an intermediate position between a pivotable connection of the holding means and the support end of the shaft means and wherein the linkage means is comprised of a cable means that extends from the trigger means, through the hollow intermediate section of the shaft means, over the change of direction means and with the cable means connecting to the holding means at a position spaced from the pivotable connection of the holding means on the shaft means.

6. The cane device of claim 1 wherein a sidewall of the intermediate section of the shaft means is provided with mounting means that provide for removably mounting an elongated shoe horn on the shaft means and wherein the shoe horn has a length that is sufficient to enable the user to put on a shoe without having to stoop out of the erect posture.

7. The cane device of claim 6 wherein the mounting means is comprised of at least two tab means having enlarged heads extending from the shaft means and wherein the enlarged heads for receiving with corresponding key-shaped openings provided in the shoe horn and wherein the shoe horn is movable axially along the shaft means to secure the enlarged heads in a restricted portion of the key-shaped openings to prevent the heads from passing therethrough to mount the shoe horn on the shaft means.

8. The cane device of claim 1 wherein a remote gripping end of the holding means is movable away from and towards the support end in response to the actuating means controllable by the trigger means and wherein the actuating means is comprised of a biasing means that biases the holding means to an extended position having the gripping end spaced from the support end and a cable means that extends from the trigger means along the length of the intermediate section of the shaft means to a terminal portion of the cable means mounted on the change of direction means that is mounted on the shaft means at an intermediate position between the pivotable connection of the holding means and the support end of the shaft means with a distal end of the terminal portion of the cable means connecting to the holding means, spaced from the pivotable connection, wherein the trigger means is actuatable to cause the cable means to move along the longitudinal axis towards the handle means with the terminal portion moving over the change of direction means to cause the holding means to pivot on the shaft means with the gripping end moving towards the support end to hold the object between the opposed surfaces provided by the holding means and the support means and wherein when the trigger means is released the biasing means causes the holding means to pivot on the shaft means, with the gripping end moved to a position, spaced from the support end of the shaft means.

9. The cane device of claim 8 wherein a locking means is provided that serves to lock the trigger means with the gripping end of the holding means abutting against the support end of the shaft means.

10. The cane device of claim 8 wherein the biasing means is a spring means that serves to bias the gripping end of the holding means spaced from the support end of the shaft means.

11. A cane device that helps a user stand in an erect posture and that enables the user to manipulate an object positioned on a lower support surface while the user stands in the erect posture, the cane device comprising:

(a) an elongated shaft means having a handle means at one end, an opposite support portion provided with a friction means for contacting the support surface in a non-slip engagement and an intermediate section along a longitudinal axis of the shaft means, wherein the shaft means has a length that enables the user to hold the handle means and position a remote end of the support portion having the friction means on the support surface to help the user stand in the erect posture;

(b) a holding means pivotably mounted on the shaft means adjacent to the support portion and movable between a closed position with a gripping end of the holding means abutting the remote end of the support portion and an extended position;

(c) a trigger means mounted on the shaft means adjacent to the handle means;

(d) a cable means that extends from the trigger means along the length of the intermediate section of the shaft means to a terminal portion mounted on a pulley means that is mounted on the shaft means at a intermediate position between the pivotable connection of the holding means and the support portion with a distal end of the terminal portion connecting to the holding means spaced from the pivotable connection, wherein the holding means is normally biased in the extended position and the trigger means is actuatable to cause the cable means to move towards the handle means with the terminal portion moving over the pulley means to cause the holding means to pivot on the shaft means to move the gripping end towards the closed position to hold the object therebetween; and (e) a righting means supported from the intermediate section of the shaft means adjacent to the support portion without interfering with the movement of the holding means so that when the cane device is released from the user's hand and comes to rest in a generally horizontal righting position on the support surface, the righting means is spaced above the support surface with a portion of the friction means opposite the righting means contacting the support surface in the non-slip engagement wherein the user can place his foot on the righting means to thereby cause the handle means to swing upwardly towards the user's hand and into a somewhat vertical position by pivoting on the support portion with the friction means preventing the support portion from slipping on the support surface so that the handle means is able to be reached by the user without the user having to stoop out of the erect posture.

12. The cane device of claim 11 wherein a locking means is provided that serves to lock the trigger means with the gripping end of the holding means abutted against the remote end of the support portion of the shaft means.

13. The cane device of claim 11 wherein a spring means serves to bias the gripping end of the holding means in the extended position, spaced from the remote end of the support portion of the shaft means.

14. A cane device that helps a user stand in an erect posture and that enables the user to manipulate an object positioned on a lower support surface while the user stands erect, the cane device comprising:

(a) an elongated shaft means having a handle means at one end, an opposite support end and an intermediate section along a longitudinal axis of the shaft means between the ends, wherein the support end is provided with a friction means for contacting the support surface in a non-slip engagement and a magnet means for engaging magnetic objects and wherein the shaft means has a length that enables the user to hold the handle means and position the support end having the friction means on the support surface to help the user stand in the erect posture;

(b) a holding means pivotably mounted on the shaft means adjacent to the support end;

(c) a trigger means mounted on the shaft means adjacent to the handle means;

(d) an actuating means controllable by the trigger means and connected to the holding means to provide for moving the holding means with respect to the support end to hold the object between opposed surfaces provided by the holding means and the support end for manipulating the object wherein a remote gripping end of the holding means is movable away from and towards the support end in response to the actuating means controllable by the trigger means and wherein the actuating means is comprised of a biasing means that biases the holding means to an extended position having the gripping end spaced from the support end and a cable means that extends from the trigger means along the length of the intermediate section of the shaft means to a terminal portion of the cable means mounted on a pulley means that is mounted on the shaft means at an intermediate position between the pivotable connection of the holding means and the support end of the shaft means with a distal end of the terminal portion of the cable means connecting to the holding means, spaced from the pivotable connection, wherein the trigger means is actuatable to cause the cable means to move along the longitudinal axis towards the handle means with the terminal portion moving over the pulley means to cause the holding means to pivot on the shaft means with the gripping end moving towards the support end to hold the object between the opposed surfaces provided by the holding means and the support means and wherein when the trigger means is released the biasing means causes the holding means to pivot on the shaft means; with the gripping end moved to a position, spaced from the support end of the shaft means; and (e) a righting means supported from the intermediate section of the shaft means adjacent to the support end without interfering with the movement of the holding means so that when the cane device is released from the user's hand and comes to rest in a generally horizontal righting position on the support surface, the righting means is spaced above the support surface with a portion of the friction means opposite the righting means contacting the support surface in the non-slip engagement, wherein the user can place his foot on the righting means to thereby cause the handle means to swing upwardly and into a somewhat vertical position towards the user's hand by pivoting on the friction means which prevents the support end from slipping on the support surface so that the handle means is able to be reached by the user without the user having to stoop out of the erect posture.

* * * * *